US007828349B2

(12) United States Patent
Chen

(10) Patent No.: US 7,828,349 B2
(45) Date of Patent: Nov. 9, 2010

(54) RESILIENT DEVICE FOR DOOR HANDLE AND KNOB

(76) Inventor: Der-Yuh Chen, No. 18, Lane 91, Kuei Jui Road, Pin Tung City (TW)

( * ) Notice: Subject to any disclaimer, the term of this patent is extended or adjusted under 35 U.S.C. 154(b) by 18 days.

(21) Appl. No.: 12/178,661

(22) Filed: Jul. 24, 2008

(65) Prior Publication Data

US 2010/0019515 A1 Jan. 28, 2010

(51) Int. Cl.
*E05B 1/00* (2006.01)

(52) U.S. Cl. ..... 292/347; 292/348; 292/356

(58) Field of Classification Search ..... 292/347, 292/348, 356, 358, 359, 336.5, 336.3, DIG. 61
See application file for complete search history.

(56) References Cited

U.S. PATENT DOCUMENTS 1,519,500 A * 12/1924 Miller ..... 292/356
4,042,268 A * 8/1977 Coglan ..... 292/347
4,790,162 A * 12/1988 Thur ..... 70/452
5,265,924 A * 11/1993 Kim ..... 292/336.3
6,264,255 B1 * 7/2001 Fortune ..... 292/336.3
6,425,273 B1 * 7/2002 Kim et al. ..... 70/224
6,869,116 B2 * 3/2005 Dalsing ..... 292/358
7,073,829 B2 * 7/2006 Kuo et al. ..... 292/357

* cited by examiner

*Primary Examiner*—Carlos Lugo
*Assistant Examiner*—Mark Williams
(74) *Attorney, Agent, or Firm*—Leong C. Lei

(57) ABSTRACT

The resilient device contains two intermediate plates stacked and sandwiched between two outer plates. The intermediate plates have a center opening for accommodating a rotational seat and a spiral spring in the gap between the rotational seat and the intermediate plates. The ends of the spiral spring are attached to the rotational seat and the intermediate plates, respectively. An axle of a door knob or a door handle runs through the outer plates and engages a saw-toothed center opening of the rotational seat. When the door handle or door knob is turned, the spiral spring is tightened as the rotational seat is turned along with the door handle or door knob. When the door handle or door knob is released later, the spiral spring expands and therefore restores the door handle or door knob back to its original, un-turned state.

1 Claim, 5 Drawing Sheets

RESILIENT DEVICE FOR DOOR HANDLE AND KNOB

(a) TECHNICAL FIELD OF THE INVENTION

The present invention generally relates to door handles and door knobs, and more particularly to a resilient device automatically restoring a door handle or door knob to its original state after it is turned.

(b) DESCRIPTION OF THE PRIOR ART

A conventional door handle or door knob usually contains a resilient device so that, after the door handle or door knob is turned, the resilient device could automatically return the door handle or door knob to its original, un-turned state. Usually, the resilient device is designed for a specific type of door handle or door knob, and is tightly coupled to that specific door handle or door knob. This lack of flexibility has compromised the practical value of the resilient device.

SUMMARY OF THE INVENTION

The object of the present invention is to provide a novel resilient device, whose main purpose is to use a single design for working with various door handles and door knobs.

The resilient device contains two intermediate plates stacked and sandwiched between two outer plates. The intermediate plates have a center opening for accommodating a rotational seat and a spiral spring in the gap between the rotational seat and the intermediate plates. An end of the spiral spring is attached to the rotational seat and the other end is attached to the intermediate plates.

An axle of a door knob or a door handle runs through the outer plates and engages a saw-toothed center opening of the rotational seat. As such, when the door handle or door knob is turned, the spiral spring is tightened as the rotational seat is turned along with the door handle or door knob. When the door handle or door knob is released later, the spiral spring expands and therefore restores the door handle or door knob back to its original, un-turned state.

A number of pins run through locking holes of the outer plates and the intermediate plates so as to fixedly join them together. The circumferences of the center openings of the outer plates are bended towards each other so as to provide a support for the rotational seat to spin.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
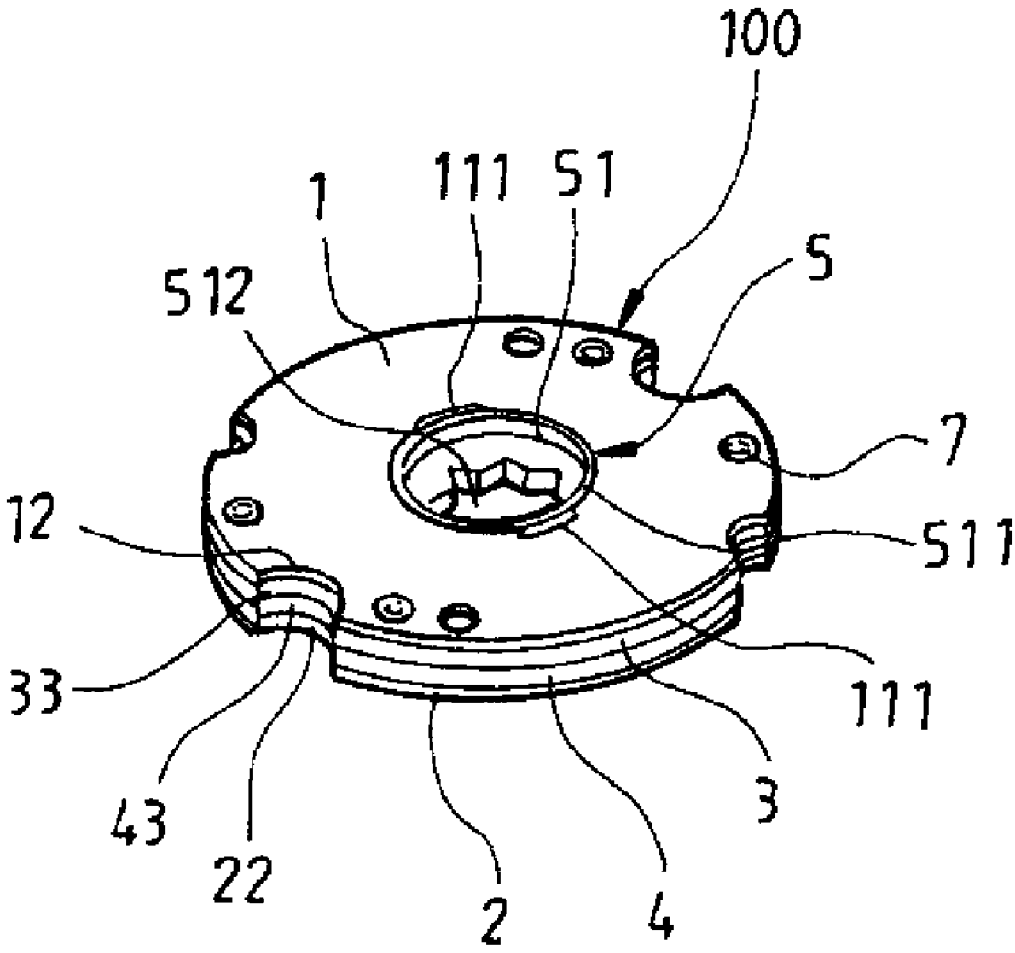
FIG. 1 is a perspective diagram showing a resilient device according to an embodiment of the present invention when it is assembled.
Figure 2:
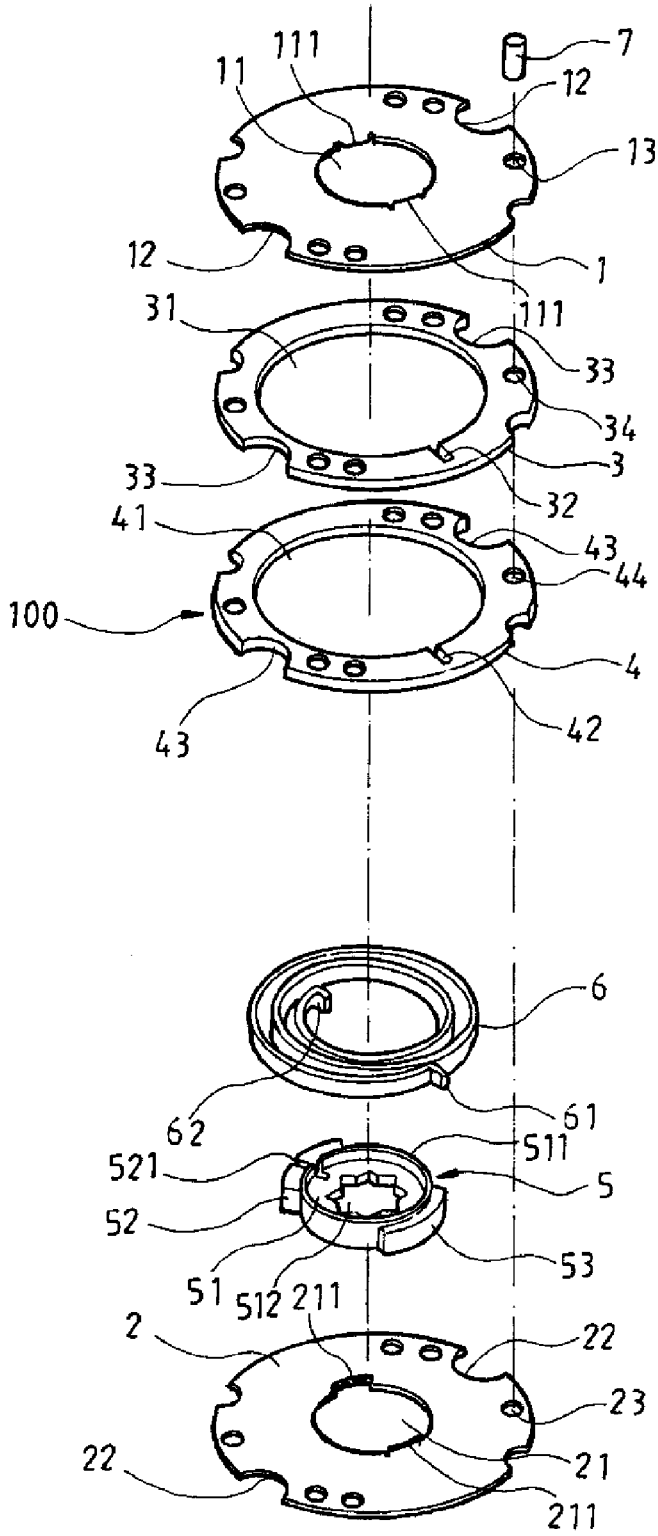
FIG. 2 is an exploded diagram showing the various components of the resilient device of FIG. 1.

As shown in the assembled and exploded diagrams of FIGS. 1 and 2, a resilient device 100 according to an embodiment of the present invention mainly contains two flat intermediate plates 3 and 4, a rotational seat 5, and a spiral spring 6, all sandwiched between a first outer plate 1 and a second outer plate 2.

The first and second outer plates 1 and 2 are generally circular in shape with center openings 11 and 21 at their centers, a number of locking holes 13 and 23 at appropriate locations, and pairs of diametrically opposing notches 12 and 22 along their circumference, respectively. The center openings 11 and 21 also have perpendicularly and inwardly bended (i.e., towards each other) flanges 111 and 211 along their respective circumference.

The intermediate plates 3 and 4 are also generally circular in shape with center openings 31 and 41 at their center having a larger diameter than that of the center openings 11 and 21. The intermediate plates 3 and 4 also have a number of locking holes 34 and 44 at appropriate locations, and pairs of diametrically opposing notches 33 and 43 along their circumference, respectively. The intermediate plates 3 and 4 have radial slots 32 and 42 at the respective circumferences of the center openings 31 and 41. When the resilient device 100 is assembled, the center openings 11, 21, 31, and 41, the notches 12, 22, 33, and 43, the locking holes 13, 23, 34, and 44, and the slots 32 and 42 are all aligned, respectively. The center openings 31 and 41 form a space between the outer plates 1 and 2 for the accommodation of the rotational seat 5 and the spiral spring 6.

The rotational seat 5 contains a circular flat piece 51 surrounded by a wall 511 so as to form an H-shaped cross section. The piece 51 has a center opening 512 having saw-toothed circumference. The center opening 512 has a smaller diameter than that of the center openings 11 and 21 of the outer plates 1 and 2. Two diametrically opposing blocks 52 and 53 are positioned along an outer surface of the wall 511. The blocks 52 and 53 have appropriate distances from a top rim and a bottom rim of the wall 511 and the block 52 further has a radially extended slot 521 on a top surface of the block 52.

The spiral spring 6 has its inner end inwardly bended and its outer end outwardly bended so as to form handles 62 and 61, respectively.

Figure 3:
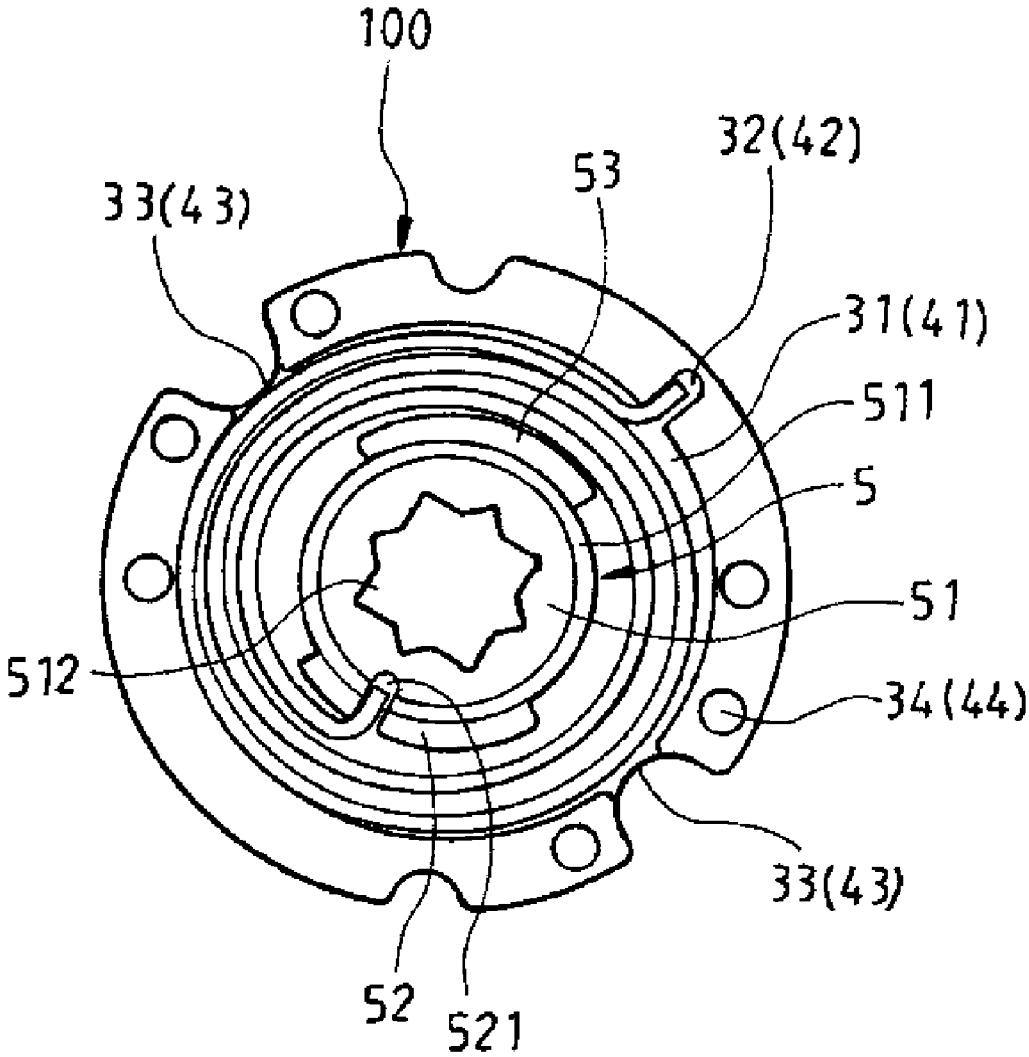
FIG. 3 is a sectional diagram showing the resilient device of FIG. 1.

As shown in FIG. 3, the assembly of the resilient device 100 is as follows. The rotational seat 5 is positioned in the center on an inner surface of the second outer plate 2 with the flanges 211 sticking inside the wall 511. Please note that, when the first outer plate 1 is joined later, its flanges 111, corresponding to the flanges 211, also stick inside the wall 511 of the rotational seat 5. As such, the rotational seat 5 is reliably held between the first and second outer plates 1 and 2, and is rotatable around the center openings 11 and 21. Then, the two intermediate plates 3 and 4 are stacked on the inner surface of the second outer plate 2, surrounding the rotational seat 5 as it is housed in the space formed by the center openings 31 and 41. The spiral spring 6 is then positioned in a gap between the rotational seat 5 and the intermediate plates 3 and 4, with its inner handle 62 embedded in the slot 521 and its outer handle 61 embedded in the slots 32 and 42. The foregoing combination is then attached to an inner surface of the first outer plate 1 and a plurality of pins 7 are driven through the aligned locking holes 13, 23, 34, and 44 to reliably and tightly hold the resilient device 100 together.

Figure 4:
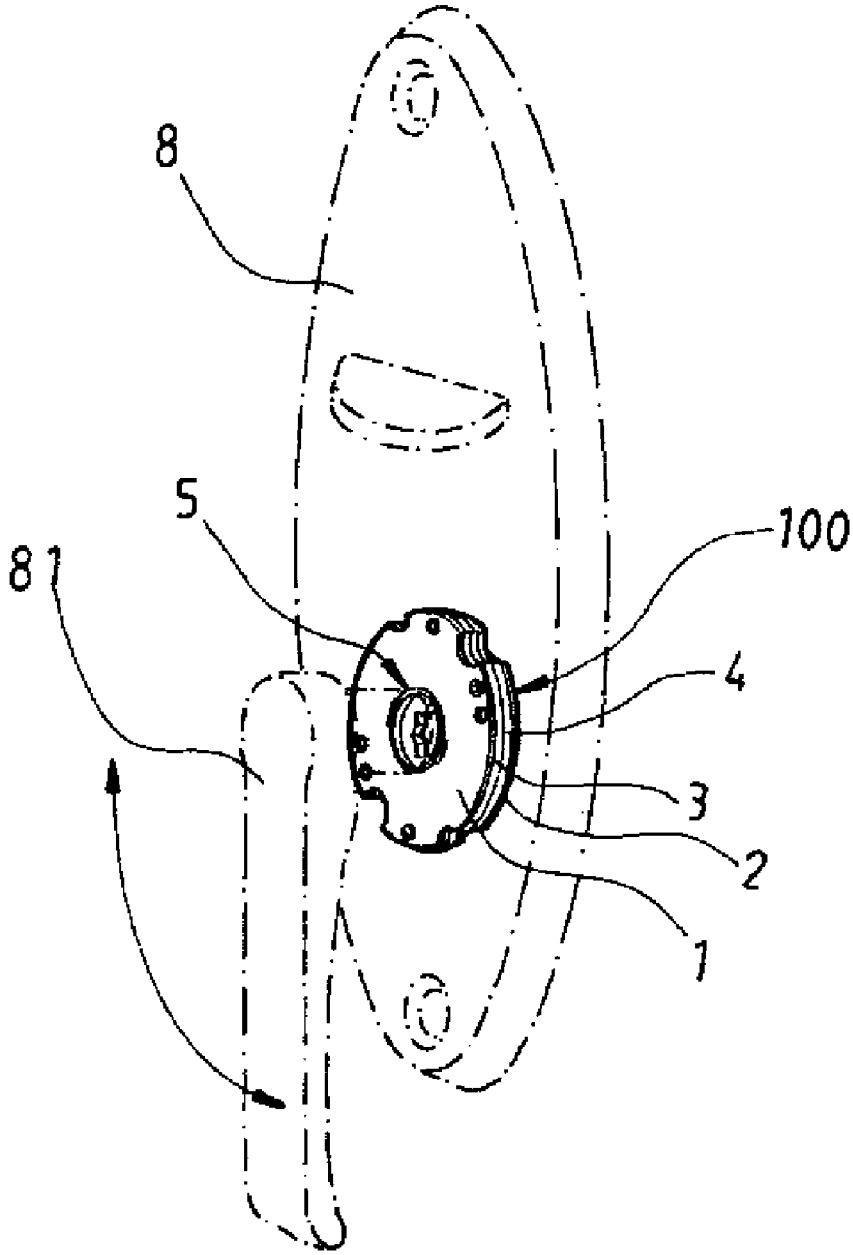
FIG. 4 shows a first application scenario of the resilient device of FIG. 1.

FIG. 4 shows a first application scenario of the resilient device 100. As illustrated, the resilient device 100 is fixedly positioned inside a door lock 8 having a door handle 81. An axle (not shown) of the door handle 81 is locked to the center opening 512 of the rotational seat 5. When the door handle 81 is turned, the rotational seat 5 is turned as well to tighten the spiral spring 6. When the door handle 81 is released, the spiral spring 6 expands to restore the door handle 81 back to its original, un-turned state.

Figure 5:
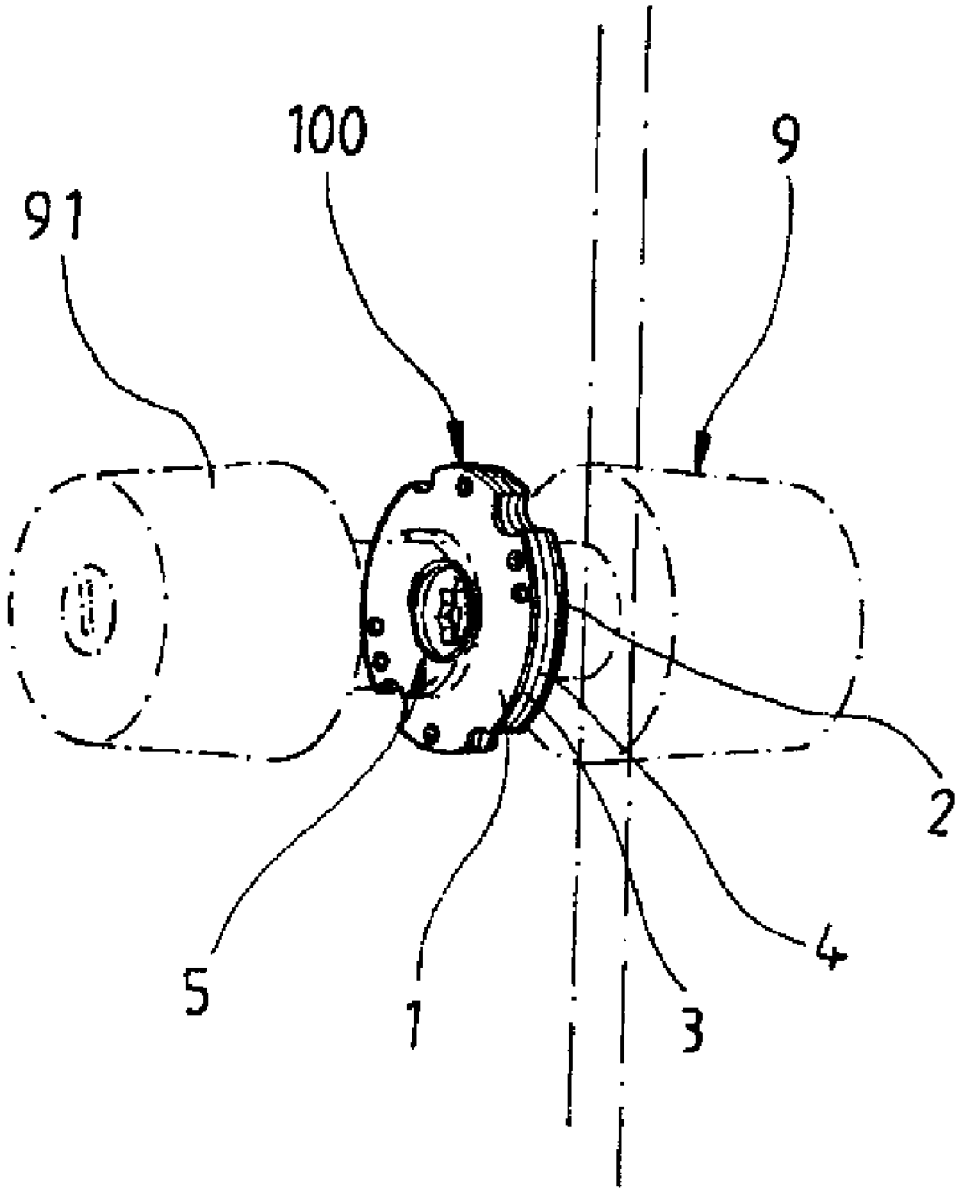
FIG. 5 shows a second application scenario of the resilient device of FIG. 1.

FIG. 5 shows a second application scenario of the resilient device 100. As illustrated, the resilient device 100 is fixedly positioned inside a door lock 9 having a door knob 91. An axle (not shown) of the door knob 91 is locked to the center opening 512 of the rotational seat 5. When the door knob 91 is turned, the rotational seat 5 is turned as well to tighten the spiral spring 6. When the door knob 91 is released, the spiral spring 6 expands to restore the door knob 91 back to its original, un-turned state.

Please note that the application of the resilient device 100 is not limited to door handle and door knob only. The resilient device could actually be applied to any similar turning devices requiring resilience for restoration.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A resilient device for a door knob or a door handle, comprising:

a first outer circular plate having a first center opening, a plurality of locking holes, and pairs of diametrically opposing notches along an outer edge of said first outer circular plate, and two opposite flanges extended perpendicularly and inwardly along a circumference of said first center opening;

a second outer circular plate having a second center opening, a plurality of locking holes, and pairs of diametrically opposing notches along an outer edge of said second outer circular plate, and two opposite flanges extended perpendicularly and inwardly along a circumference of said second center opening;

two circular intermediate plates mounted between said first and second outer circular plates, each of said intermediate plates having a center opening which is larger than said first and second center openings in diameter thereby forming a space between said intermediate plates and said first and second outer circular plates, a plurality of locking holes aligned with said locking holes of said first and second outer circular plates, pairs of diametrically opposing notches along a circumference of said intermediate plates and aligned with said notches of said first and second outer circular plates, and a first radial slot at a circumference of said center opening of said intermediate plates;

said first and second outer circular plates and said intermediate plate being fastened together by engaging pins with said locking holes;

a rotational seat rotatably housed in said space, said rotational seat having a flat piece surrounded by a wall and two diametrically opposing blocks positioned along an outer surface of said wall, said flat piece having a center opening having a saw-toothed circumference and being smaller than said first and second center openings of said first and second outer circular plates in diameter, said blocks having a distance from a top rim and a bottom rim of said wall, one of said blocks having a second radial slot on a top surface thereof; and a spiral spring positioned in a gap between said rotation seat and said intermediate plates, said spiral spring having an inwardly bended inner end and an outwardly bended outer end which are embedded in said first slot of said intermediate plates and said second slot of said rotational seat;

wherein an axle of said door knob or said door handle is extended inside and locked to said center opening of said rotational seat; when said door knob or said door handle is turned, said rotational seat is turned as well to tighten said spiral spring; and, when said door knob or said door handle is released, said spiral spring expands to restore said door knob or said door handle back to an original, un-turned state.

* * * * *